US006563427B2

(12) United States Patent
Bero et al.

(10) Patent No.: US 6,563,427 B2
(45) Date of Patent: May 13, 2003

(54) PROXIMITY MONITORING COMMUNICATION SYSTEM

(75) Inventors: Robert J. Bero, Spring Grove, IL (US); William P. Alberth, Jr., Crystal Lake, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/967,239

(22) Filed: Sep. 28, 2001

(65) Prior Publication Data

US 2003/0063003 A1 Apr. 3, 2003

(51) Int. Cl.[7] ..... G08B 23/00

(52) U.S. Cl. ..... 340/573.1; 340/573.4; 340/539.11; 340/568.1; 340/825.24

(58) Field of Search ..... 340/573.1, 573.4, 340/539, 568.1, 825.24

(56) References Cited

U.S. PATENT DOCUMENTS 5,223,815 A * 6/1993 Rosenthal et al. ..... 340/539
5,485,163 A 1/1996 Singer et al.
5,801,627 A * 9/1998 Hartung ..... 340/573
5,812,056 A 9/1998 Law
5,892,447 A * 4/1999 Wilkinson ..... 340/573.4
5,943,628 A * 8/1999 Barrett et al. ..... 340/573
5,995,007 A * 11/1999 Borja et al. ..... 340/573.4
6,031,460 A 2/2000 Banks
6,075,442 A 6/2000 Welch

* cited by examiner

*Primary Examiner*—Daniel J. Wu
*Assistant Examiner*—Hung Nguyen
(74) *Attorney, Agent, or Firm*—Brian M. Mancini

(57) ABSTRACT

A method of personal location monitoring in a wireless communication system operating on a local area network. The method includes initializing a master communication device and a slave monitor device on the local area network. A next step transmitting a signal on the local area network by the slave monitor device. A next step includes the communication device receiving the signal on the local area network and measuring the signal strength which is compared to a threshold. A next step includes triggering an alarm in the communication device when the signal strength falls below the threshold, indicating that the monitor device is straying from the proximity of the local area network.

12 Claims, 6 Drawing Sheets

PROXIMITY MONITORING COMMUNICATION SYSTEM

FIELD OF THE INVENTION

The present invention relates generally to monitoring the proximity of persons or objects, and more particularly to a communication system for use in monitoring the proximity of persons or objects.

BACKGROUND OF THE INVENTION

The recent explosion of wireless communication devices and applications lends itself to many uses besides basic communications. The predominant use of such devices has been to allow family and friends to keep in touch with each other. However, due to high monthly fees it has been uneconomical to provide such devices to small children. In addition, very small children would not be able to properly operate the typical cellular phone. However, it is of paramount concern to monitor children for their safety. Therefore, the solution has arisen to use wireless technology to satisfy the need to provide child location systems.

One prior art solution is to use the Global Positioning System to provide location services. Although effective, the cost of the technology is prohibitive, and there is little call to locate a person or object anywhere on the globe. This is also true in the case of child location. Another prior art solution has been to install radio frequency (RF) tags, such as in a car for example, which can transmit a location of the car if it is stolen. Again the technology is expensive and requires a large transmitter power source, such as a car battery. In addition, special receivers and software are needed to detect the signal. Another prior art solution uses cellular technology to locate a control signal scan of a cellular device. However, this technique requires on-board emergency activation circuitry and a high power source for the continuous multicell control signal scan and response transmissions thereto. All of the above suffer from high expense, being impractical, or being difficulty to use.

Other prior art solution attempt to provide a relatively lower cost solution. One such solution provides similar communication devices between a guardian and a child operable on a cellular network. However, such devices require complicated addressing and timing schemes to avoid interference with similar local devices. Other solutions provide a transmitter beacon on a child, which is simple, and a directional receiver with a location display for the parent. However, the directional receiver requires special hardware and constant monitoring of the parent. This simplistic method is little better than the parent keeping a constant eye on the child, which is still the method used most frequently today. Still another solution provides a customized system that provides a bracelet transceiver for the child and a monitor transceiver for a parent, wherein the parent can signal the bracelet to let the child know to return to the parent. However, this system is not autonomous and requires a positive action on the part of the parent to provide a system activation signal.

Accordingly, there is a need for an improved monitoring communication system that autonomously monitors proximity of a person or object. In particular, it would be of benefit to be able to define the proximal boundaries of the system, and to automatically alert if the boundary is violated. It would also be advantageous if current low-cost technology could be used without the requirement for customized hardware. A further benefit would allow the automatic hand-off or transfer of monitoring capabilities between communication devices.

SUMMARY OF THE INVENTION

The present invention is directed to a method and system of proximity monitoring in a wireless communication system operable on at least two wireless local area networks. The invention is operable using at least two master communication devices supporting respective wireless local area networks, and at least one wireless monitor device as a slave unit operable in either of the wireless local area networks. The master and slave devices transceiver signals on the respective wireless local area network of the master device. The transceived signals are used for proximity monitoring of the salve device by the master device.

One aspect of the present invention is the triggering of an alarm in a master device when the slave device is no longer in proximity thereto. This is applicable to one or more master devices that are able to monitor the slave device on its respective local area network. In particular, master devices can transfer proximity monitoring responsibilities of the slave device between themselves. Transferring includes a wide area network communication between the master units indicating a transfer is to take place. A time-out period is provided for the slave device to transfer between the local area network of the master devices. If the time-out period expires before the transferring is complete, an alarm is sounded. An acknowledgement is provided between the master devices to confirm the transferral.

Another aspect of the present invention is the measuring the signal strength threshold of a slave device to defined a proximity boundary for the device in the local area network.

Another aspect of the present invention is the measuring the signal strength threshold of a slave device to defined a proximity boundary for the device in the local area network, which is assigned to all the slave devices in the local area network to define a group threshold.

Another aspect of the present invention is slaving the slave device to the master device providing the strongest received signal from a master device.

Another aspect of the present invention is the querying of other master devices to locate a slave device that is no longer in proximity.

DETAILED DESCRIPTION OF THE PREFERRED EMBODIMENTS

The present invention provides an improved monitoring communication system that autonomously monitors proximity of a person or object. Proximal boundaries can be preset to automatically monitor and alert if the boundary is violated. The present invention can use current low-cost technology without the requirement for customized hardware and is easy to use. In addition, automatic hand-off or transfer of monitoring capabilities between communication devices can be accomplished.

The present invention can advantageously be used in those wireless radio communication systems that utilize a wide area network along with a local area network. In particular, the proposed third generation (3G) radio communication systems specify different cell sizes defining wide area networks (megacell, macrocell) and local area networks (microcell, picocell). The present invention can be implemented on a very compact and cost effective way, which is desirable for small transceiver devices that are most effective in picocell local area networks, such as are defined for the Bluetooth™ system (Specification on the Bluetooth System, Ver. 1.1, Feb. 22, 2001), for example.

Figure 1:
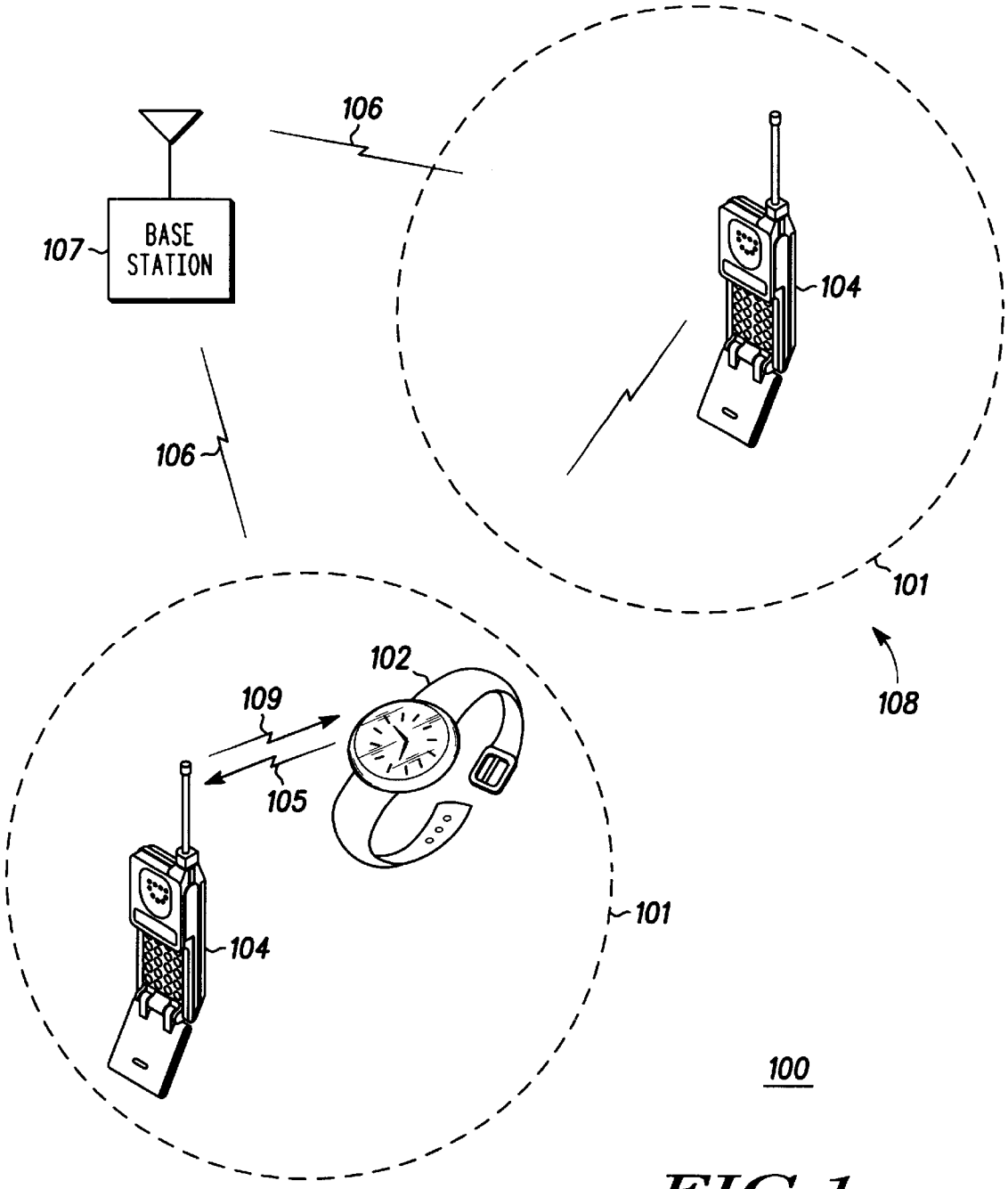
FIG. 1 shows a simplified schematic diagram of a proximity monitoring communication system, in accordance with the present invention.

FIG. 1 illustrates a proximity monitoring communication system 100 for a wireless local area network 101. Preferably, the local area network is a Bluetooth™ piconet. The system 100 includes at least one wireless monitor device 102 and at least one wireless communication device 104. For child monitoring, it is envisioned that the at least one wireless monitor device 102 is worn as a bracelet, tag or other device worn by a child, and the at least one wireless communication device 104 is a cellular phone used by a parent or guardian. The at least one wireless monitor device 102 is operable as a slave unit in the local area network. The at least one wireless monitor device 102 includes a unique identifier for each monitor device. This is already provided in devices operable under the Bluetooth™ standard. The at least one wireless monitor device 102 transmits a signal 105 on the local area network 101.

In the simplest embodiment, the monitor device 102 includes a transmitter which broadcasts its identification code, signal or number to the at least one wireless communication device 104, which receives it. The transmitting and receiving (polling) can occur periodically. For example, the transmit signal can be constant or preferably occurs periodically to save battery current. This signal can be polled at 1.28 ms intervals as is provided for in the standard. This polling rate can also be reduced to further save battery current if the strength of the received signal is constant for several minutes, such as if parent and child are riding in a car together. Preferably, the monitor device includes a transceiver so that two-way communication can be held, as will be described below. Other circuits are also incorporated in the monitor device and communication device for the proper operation as provided for in the Bluetooth™ standard.

The at least one wireless communication device 104 is operable as a master unit of the local area network 101. The at least one wireless communication device 104 is operable to measure a strength of the received signal 105, or just the signal itself from the at least one wireless monitor device 102. Preferably, the measure of strength is a received signal strength indicator (RSSI), as is known in the art. If a received signal is no longer detected or the signal strength is less than a predetermined threshold, an alarm is triggered indicating that the at least one wireless monitor device 102 is straying from the proximity (shown as dotted line 101) of the local area network. In this case, the alarm can occur on the at least one wireless communication device 104 and on the particular monitor device 102. Optionally, the alarm can also be transferred to another master/slave local area network 108 to trigger that associated master or slave unit. This optional trigger can be communicated directly between master units through a wide area network signal 106 through a base station 107, using a compatible cellular telephone protocol or directly between master units 104. The present invention also allows multiple master units and slave units to merge within a single local area network, or to separate therefrom, seamlessly, such that monitor device 102 responds to the nearest authorized master unit 104 in any local area network 101.

The present invention also provides that the at least one wireless monitor device includes a power control, wherein if the power control is defeated while the at least one monitor device is in communication with the local area network, the alarm will be triggered in the at least one wireless communication. For example, where the monitor device is configured as a bracelet to be worn by a child, the power control would include turning on the power to the monitor device when clipped around the child's wrist, and the power can only be interrupted by removal of the bracelet. An attempt to remove the bracelet by the child will defeat the power control. Therefore, if the bracelet is within an active local area network when this occurs, then an alarm will sound on the master unit (and slave unit). No power control alarm will sound if the monitor device is outside the local area network or if the bracelet is not active on the network.

The above embodiments only require a transmitter in the monitor device. However, if a transceiver is provided, two-way communication can be utilized to advantage. In particular, the monitor device can transmit the signal 105 as described above, the communication device can transmit a second signal 109 to the monitor device on the local area network 101. In this embodiment, the at least one wireless monitor device is operable to measure a strength of the received second signal 109 from the at least one wireless communication device 104. If the received second signal strength is less than a second predetermined threshold, an alert is triggered on the at least one wireless monitor device 102. In practice, the predetermined threshold is less than the second predetermined threshold such that the alert occurs before the alarm. The purpose of this feature is to warn or prompt the child, for example, to keep within the proximity of the parent or guardian without constantly triggering the alarm of the parent or guardian. Such an alert-only mode would occur as the child skirts the boundary of the local area network. Optionally, the monitor unit can slave itself to any of the nearby authorized master units having the strongest received second signal. This can occur whether the local area network for each master unit is merged or separate.

The present invention also envisions the transfer of the at least one monitoring device between master units. If the local area networks are merged, as previously discussed, there will be no alarm and transfer is automatic to the strongest master unit. However, if the master units and their associated local area networks are separate, then means are need to prevent an alarm while the monitor device is in transit between the local area networks. This can be accomplished where the first and second wireless communication devices are operable on a compatible wide area network. Each communication device supports separate local area networks, respectively. The first communication device communicates to the second communication device on the wide area network that the at least one monitor device will be transferred from the local area network of the first communication device to the local area network of the second communication device. In this case, the first communication device provides a timeout period for the at least one monitor device to transfer to the local area network of the second communication device before the alarm is triggered. The second communication device can acknowledge receipt of the monitor device signal to the first communication device back through the wide area network. If this is accomplished before the timeout, then no alarm will sound. In addition, the first communication device can also transmit the time-out period to the second communication device, wherein if the second communication device does not receive the signal of the monitor device within that time-out period, an alarm will sound on the second communication device. Preferably, the wide area network signaling is performed on the paging channels of the compatible cellular telephone protocol. For example, such messaging can be accomplished on a Short Messages Service (SMS) channel in a GSM (Global System for Mobile communication), as is known in the art. In practice, all wide area network communication is carried out on a compatible cellular radiotelephone system and the at least one monitor device is operable on a Bluetooth™ piconet system. It is also envisioned that if a slave unit becomes lost a superuser can poll all the available piconets to determine if the slave unit is present in any of those cells.

Figure 2:
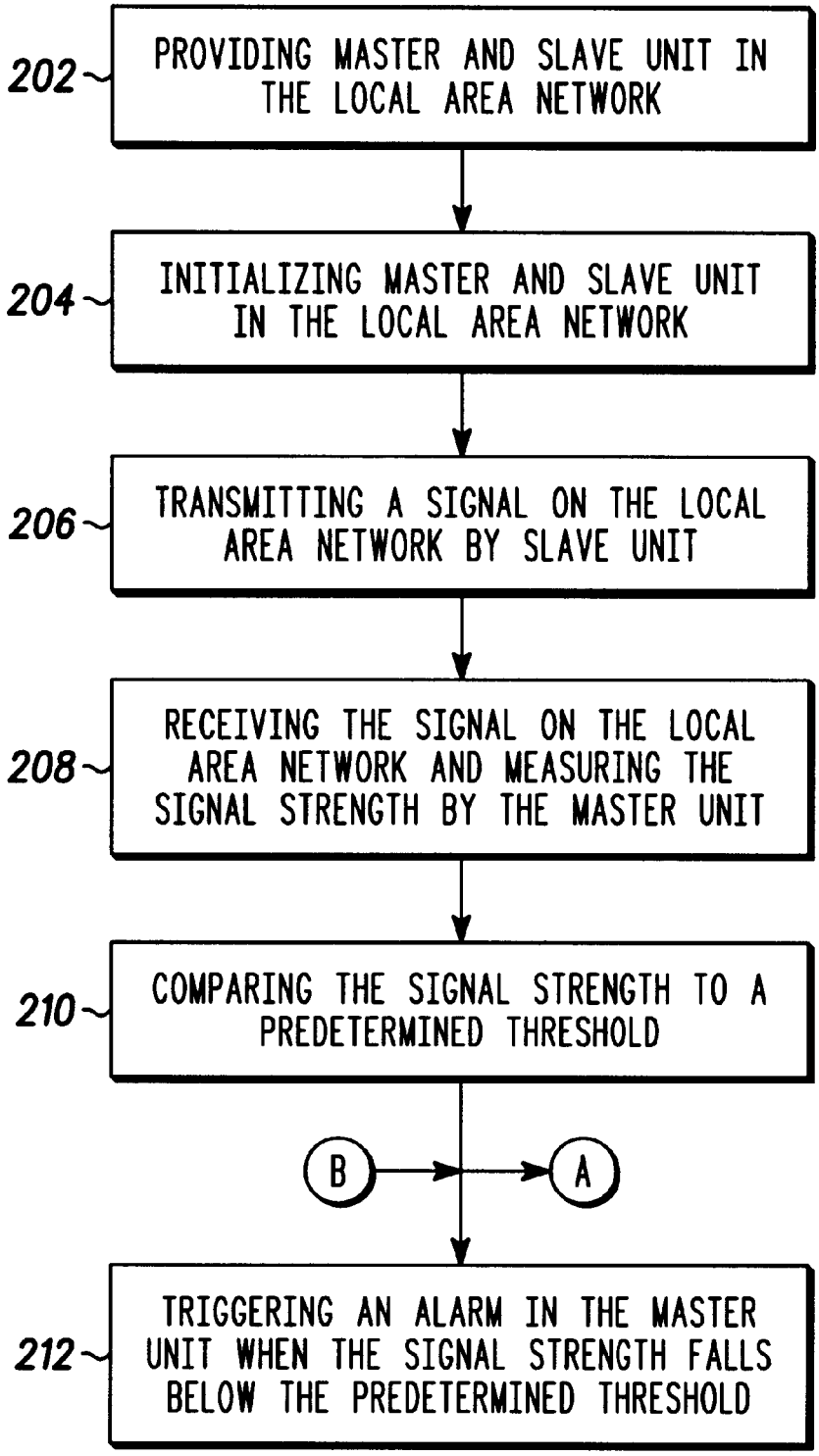
FIG. 2 shows a flow chart of a first embodiment of proximity monitoring, in accordance with the present invention.

As shown in FIG. 2, the present invention provides a method of proximity monitoring in a wireless communication system operable on a local area network. The method includes providing 202 at least one communication device as a master unit in the local area network and at least one monitor device as a slave unit in the local area network (as represented in FIG. 1). Multiple master units, slave units, and local area networks can be included, as will be described below. Preferably, the at least one communication device is operable on a compatible cellular radiotelephone system and the at least one monitor device is operable on a Bluetooth™ piconet system. A next step includes initializing 204 the at least one communication device and the at least one monitor device in the local area network.

Figure 3:
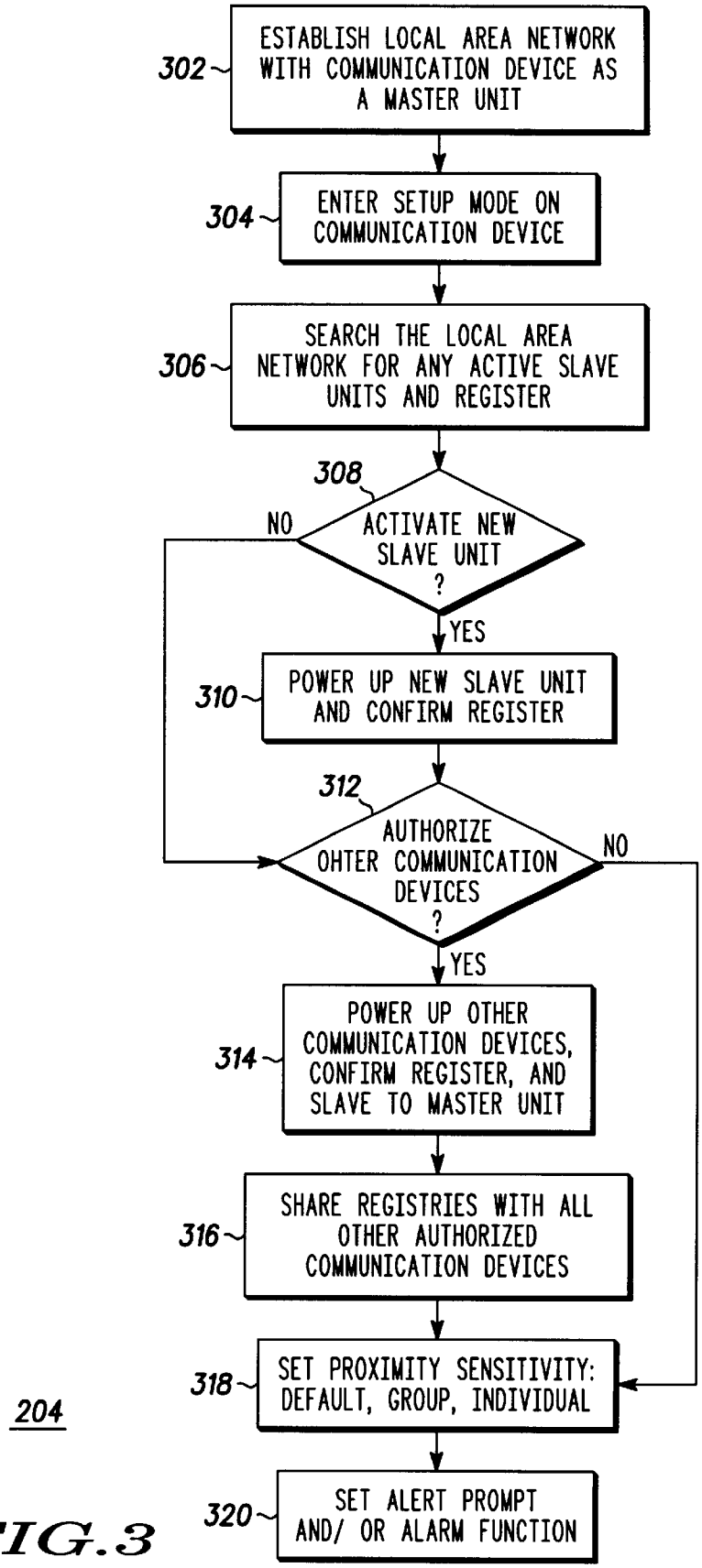
FIG. 3 shows a flow chart of initialization of the communication system, in accordance with the present invention.

FIG. 3 shows a flow chart of the substeps of initializing. At the beginning, a communication device is turned on and would establish 302 a local area network with itself as the master unit. Preferably, a Bluetooth™ network is established. More preferably, the communication device has preprogrammed software that is operable in accordance with the present invention. In this way, the proximity monitoring function can be menu-selectable. When the proximity monitoring function is selected, the communication device enters a set-up mode 304. The master unit searches 306 the local area network for any active slave units that have been preprogrammed into communication device. In particular, slave units operable on the Bluetooth™ standard have unique identification numbers preprogrammed therein. This provides an advantage for overlapping local area networks wherein only an authorized master unit can access its associated slave units.

If a new slave unit is to be activated 308 on the local area network, the new slave unit can be powered up 310, such as by placing a bracelet monitor (slave) device on a wrist of a child for example. After this, the menu on the master unit can be reselected to run the set-up mode again, or registry of new slave devices can be done automatically by periodic polling for slave devices. In either case, the master unit can register the identification of the newly activated slave unit. Using text entry, a user can enter a name to associate with the new identification on the master unit. Preferably, the master unit can have pre-stored names associated with each programmed identification, e.g. a child's name associated with a particular slave identification. In operation, the name can be shown on a display of the master unit when the slave unit is active on the local area network. Alternatively, a child's name can flash on the display if the slave unit drops off the active local area network, as will be described below. As a check, the user can turn off the registered slave unit to see if the master unit operates properly to note the dropping of the slave unit from the local area network. These steps can be repeated to add any number of slave units to the local area network.

In addition, other authorized communication devices can be added on the local area network, although these will be slaved to the originating master unit. For example, other adults in a party can be added to act as authorized master units to children wearing the monitor devices (slave units). To add another adult 312 to a local area network, the new communication device is turned on 314, its identification number is registered with the originating master unit, an associated name is text entered if not already previously stored, and the new unit is slaved to the originating master unit. These steps can be repeated for all new adult units to be added. Once the adults units are added, a list of all registered monitor (slave) device identifications, associated names, and other adult unit identification and names are transmitted to all adult units 316.

The sensitivity of the proximity monitoring can also be set 318 at this time. This can also be menu-selected. As a default, the master unit(s) and slave unit will alarm if the slave unit drops off the local area network or a signal strength from the slave unit falls below a preset threshold. This default mode is already set-up and requires no action on the part of the user of the master unit. Optionally, the master unit can be programmed to set a desired proximity for one or all of the slave units on the local area network. This can also be menu selected. For example, a group proximity threshold can be set by using one slave unit. The slave unit is sent a desired distance from the master unit, and the master unit is directed to store the signal strength received from that one slave unit as a group threshold, wherein any slave unit on the local area network that has a received signal strength that falls below the group threshold will trigger an alarm on the master unit(s) and the offending slave unit. As another option, the master unit can be programmed to set a desired proximity for the slave units individually on the local area network. This can also be menu selected. For example, individual thresholds are set by sending each slave unit to the desired distance for that unit, and the master unit is directed to store the signal strength received from each slave unit as that unit's threshold, wherein any slave unit on the local area network that has a received signal strength that falls below its individual threshold, or if the signal is lost, an alarm will trigger on the master unit(s) and the offending slave unit. The type of alert or alarm prompt can also be menu-selected 320 at this time, as will be explained below In operation, and referring back to FIG. 2, the next steps in the proximity monitoring process include transmitting 206 a signal on the local area network by the at least one monitor (slave) device, and receiving 208 the signal on the local area network and preferably measuring the signal strength by the at least one communication (master) device. In the above embodiments, it is only necessary that the slave units have transmit capabilities on the local area network. However, if the slave units are provided with transceivers, further functionality can be added. For example, a slave unit can be set up to measure a second signal strength from the master unit(s). The master unit can activate a second predetermined threshold to trip an alert in the slave unit when the second signal strength from the master unit falls below the second threshold. Preferably, the predetermined threshold is less than the second predetermined threshold such that the triggering of the alert on the slave unit occurs before the triggering of the alarm on the master unit. For example, if a child with a monitor device strays close to the boundary of the local area network, the received signal strength from the master unit will fall below the second threshold on the monitor unit before the received signal strength from the monitor unit falls below the threshold in the master unit. In this way, an alert is triggered in the monitor device without an alarm being triggered in the master unit, if the monitor device is close to dropping off the local area network, e.g. a child will be prompted to stay close to the adult before the adult's alarm sounds. Only if the child continues in their path off the local area network will the adult alarm sound. This can also be accompanied by a second alarm on the child's monitor device.

Alternatively, the master unit can compare the signal strength from the monitor device against both the predetermined threshold and the second predetermined threshold. If the signal strength falls below the second predetermined threshold, an alert command is sent to the monitor device, which receives it and provides an alert. If the signal strength continues to fall, below the predetermined threshold, an alarm command can be sent to the monitor device (as well as the master device) indicating that the slave unit is falling off the local area network.

The next steps includes comparing 210 the signal strength to a predetermined threshold, as described above, and triggering 212 an alarm in the at least one communication device when the signal strength falls below the predetermined threshold(s), indicating that the at least one wireless monitor device is straying from the proximity of the local area network. The alarm can also be triggered in the monitor device. The alert and alarm can be any combination of auditory, vibratory or optical signals. In addition, a pre-stored speech recording can be used. Preferably, the transmitting, receiving, comparing and triggering steps are repeated at periodic intervals. In the Bluetooth™ system, repeated polling takes place at a nominal 1.28 ms period.

In a preferred embodiment, the providing step 202 includes the at least one wireless monitor device having a power control, and wherein the triggering step 212 includes triggering the alarm when the power control is defeated. In this way, if a child removes, turns off, or in some other way defeats the monitor bracelet, the adult will know by the alarm. It is also preferred that the monitor device include a transceiver instead of just a transmitter. In this way, the monitor device can communicate in a two-way manner with the master unit. In particular, the transmitting step 206 can include the at least one communication device transmitting a second signal on the local area network, the receiving step 208 can then include the at least one wireless monitor device measuring a strength of the received second signal, and the triggering step 212 would include triggering an alert on the at least one wireless monitor device when the received second signal strength is less than a second predetermined threshold. Such an alert, when triggered on the monitor device, being worn by a child for example, would prompt the child when there is a threat that the child might leave the proximity of the adult. Moreover, reception capability on the monitor device would allow slaving each of the at least one wireless monitor devices to the at least one authorized wireless communication device with the strongest received second signal from the receiving step. In this way, the child can move more freely as long as staying within the proximity of an authorized adult communication device.

Figure 4:
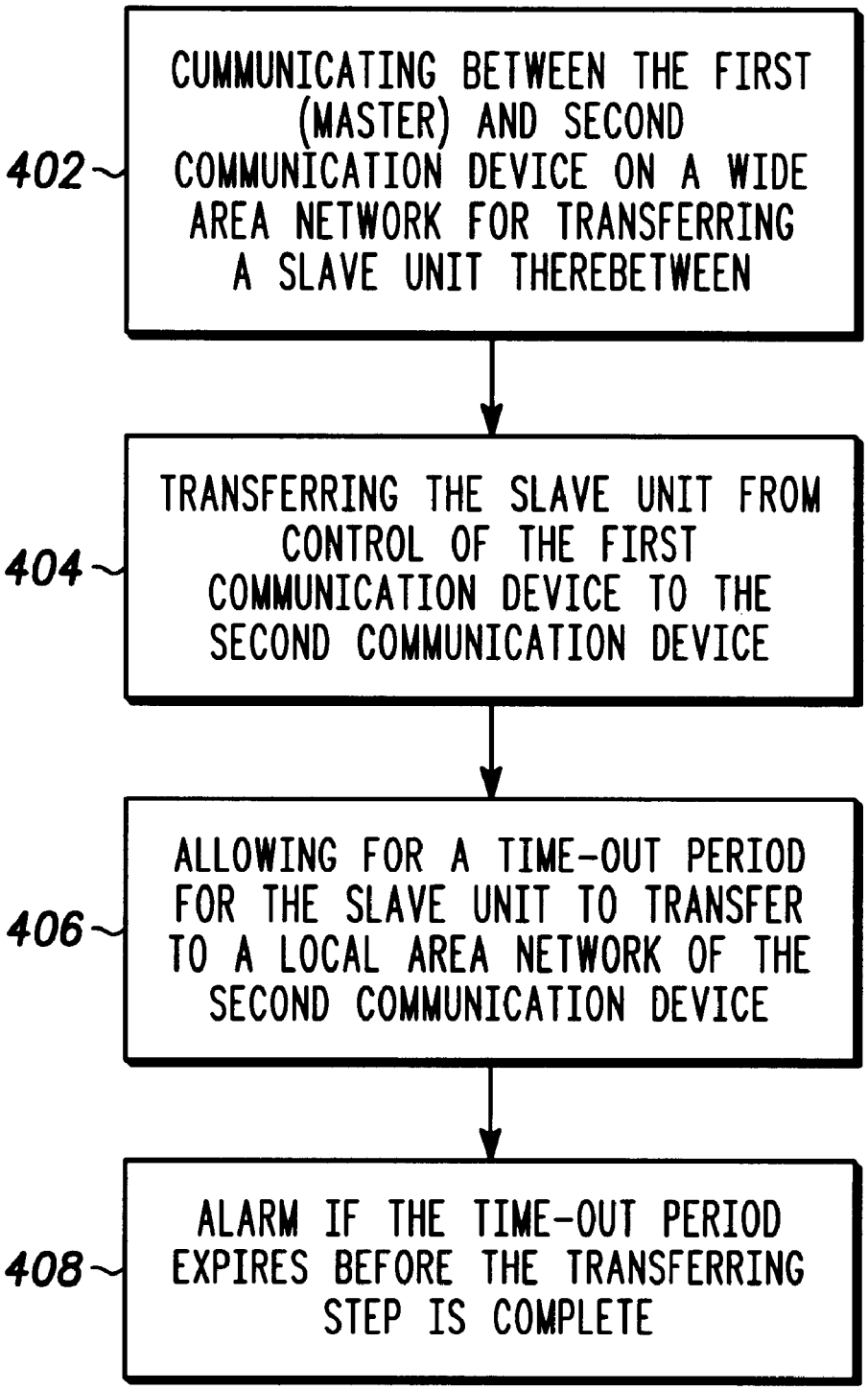
FIG. 4 shows a flow chart of a second embodiment of proximity monitoring, in accordance with the present invention.

In practice, the providing step 202 includes first and second wireless communication devices being operable on a compatible wide area network, while each communication device supports separate local area networks, respectively. In this way, further functionality can be accommodated. A transfer embodiment, as represented in FIG. 4 includes the steps of: communicating 402 between the first and second wireless communication device on the wide area network for transferring the at least one monitor device therebetween, transferring 404 the at least one monitor device from control of the first communication device to the second communication device, and allowing 406 for a time-out period for the at least one monitor device to transfer to the local area network. In this instance, the triggering step includes triggering the alarm 408 if the time-out period expires before the transferring step is complete.

Figure 5:
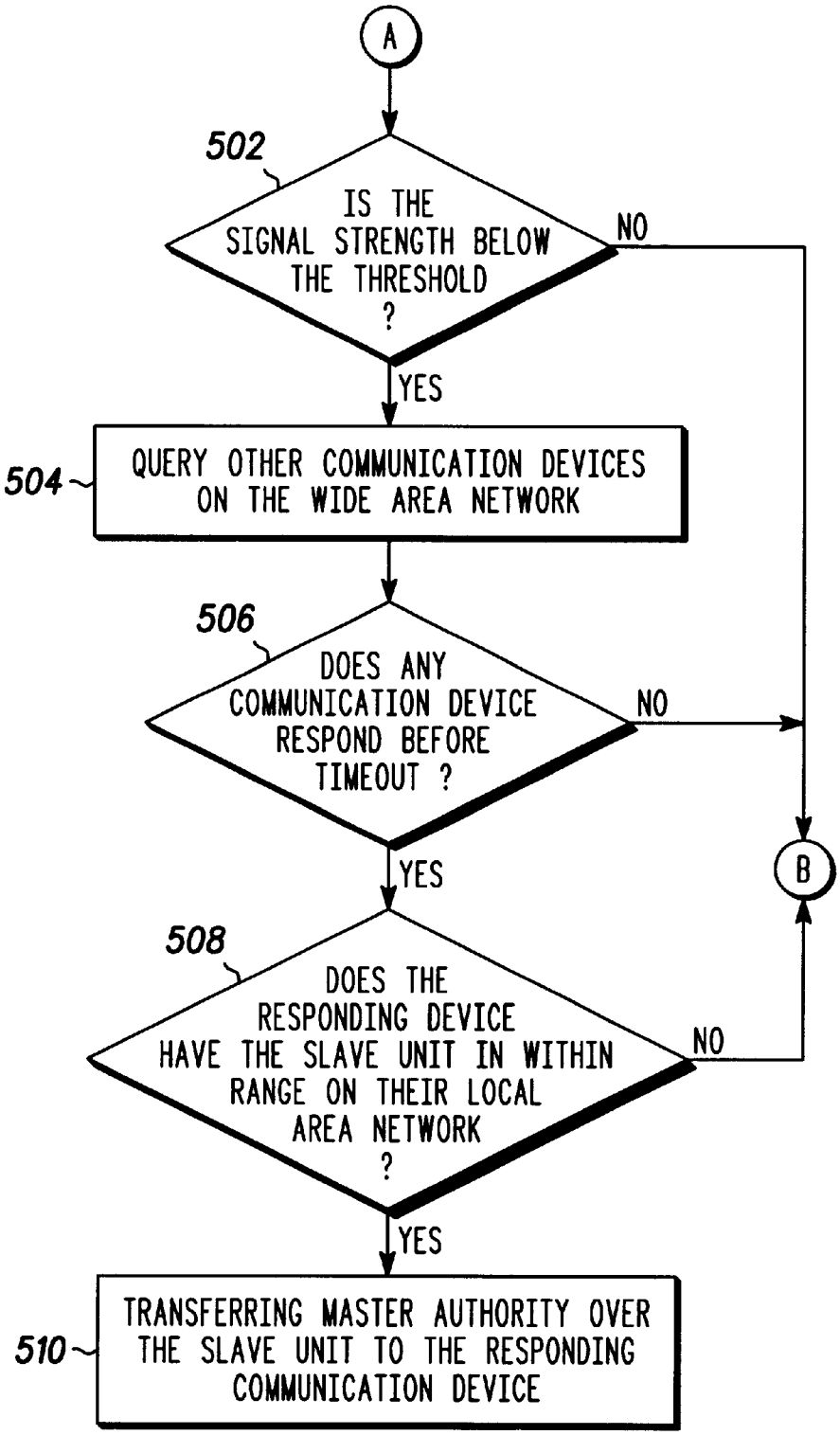
FIG. 5 shows a flow chart of a transfer embodiment of proximity monitoring, in accordance with the present invention.

In another embodiment of FIG. 5, where there are two or more communication devices, further steps can be included after the comparing step (210 of FIG. 2) wherein, if the signal strength from the slave unit to the master unit falls below the threshold 502, the master communication device proceeds by sending a request on the wide area network (using SMS for example) to query 504 the other communication device to see if this communication device has the particular slave unit in question within range on their piconet 508. If none of the other communication devices reply after a pre-determined timeout 506 or all such other communication device respond in the negative 508, then the alarm will sound as in the triggering step (212 of FIG. 2). However, if another communication device does respond affirmatively within the allotted timeout 506, that the slave unit is within their proximity 508, then the master unit can proceed by transferring 510 master authority over the slave unit to the other affirmatively responding communication device.

Figure 6:
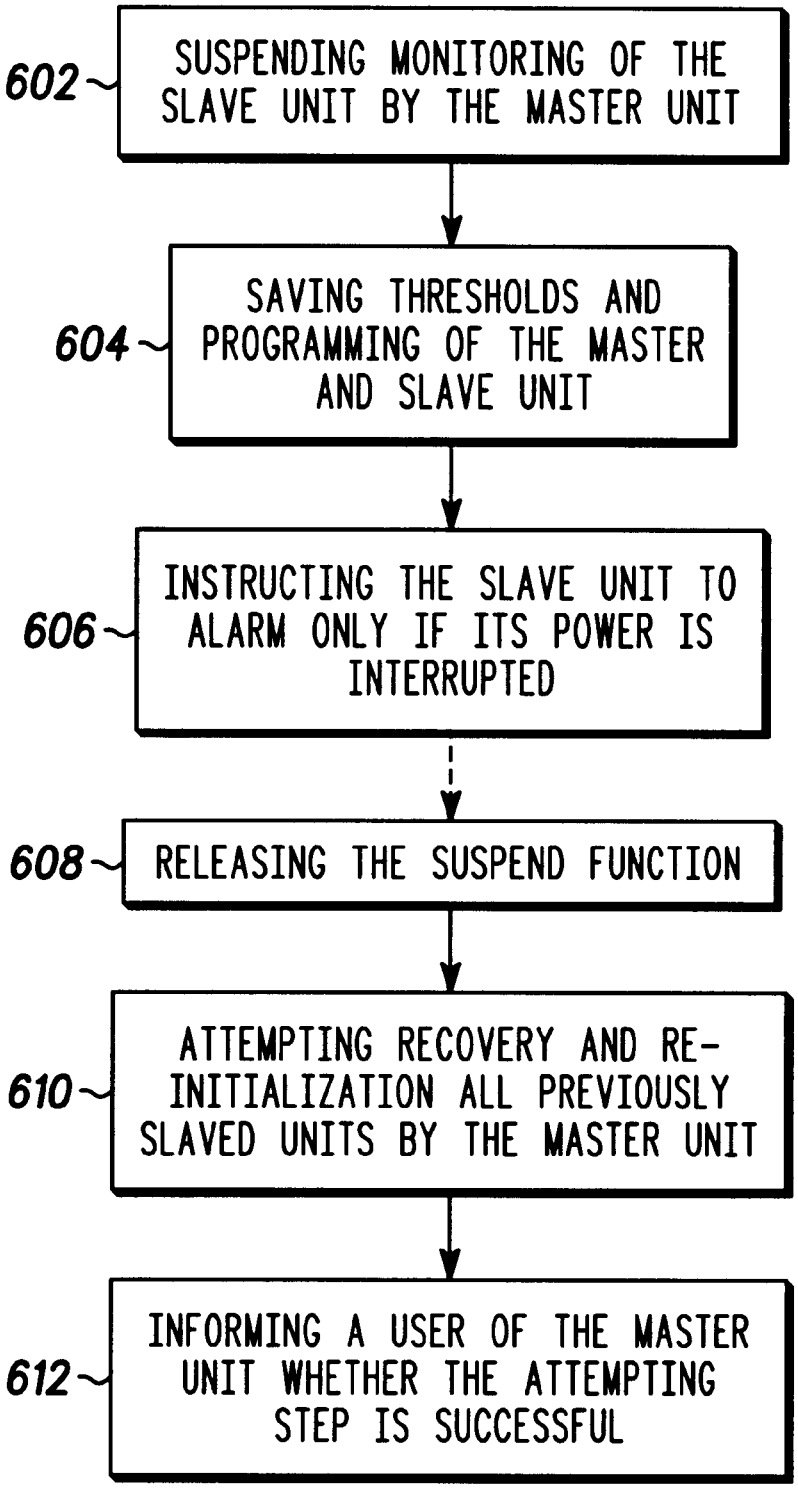
FIG. 6 shows a flow chart of a suspend embodiment of proximity monitoring, in accordance with the present invention.

In a suspend embodiment of FIG. 6, the master unit can suspend 602 monitoring of the slave unit. For example, a child can be allowed to play in the playground without worry of setting off an alert or alarm. In this case, the master unit suspends 602 signal monitoring while saving thresholds and programming 604. The slave unit is instructed 606 to alarm only if its power is interrupted. The master unit can alarm also. Monitoring is then suspended if and until a user decides to release the suspend function. When the master unit releases 608 the suspend function, the master unit attempts 610 to recover and initialize all previously slaved units. The master unit informs 612 the user whether the attempt at recovery and re-initialization is successful or not. This can be by text or speech message, display indication, alarm, and the like.

The previous embodiments have all required received signal strength measurements (RSSI) measurements. Another embodiment would trigger an alarm if the master unit can no longer receive any signal from the slave unit. This would simplify the system by eliminating the need for circuitry to generate RSSI data, but would also eliminate some of the flexibility for differentiated alerts and alarms.

Although the invention has been described and illustrated in the above description and drawings, it is understood that this description is by way of example only and that numerous changes and modifications can be made by those skilled in the art without departing from the broad scope of the invention. Although the present invention finds particular use in portable cellular radiotelephones, the invention could be applied to any communication device, including pagers, electronic organizers, and computers. The present invention should be limited only by the following claims.

What is claimed is:

1. A method of proximity monitoring in a wireless communication system operable on at least two wireless local area networks, the method comprising the steps of:

providing at least two wireless master communication devices supporting respective wireless local area networks and at least one wireless monitor device as a slave unit operable in the wireless local area networks;

transceiving signals between the at least one monitor device and at least one of the master communication devices on the respective wireless local area network;

triggering an alarm in at least one of the master wireless communication devices when there is an indication that the at least one wireless monitor device is no longer within the proximity of either of the wireless local area networks; and transferring the monitoring of the at least one monitor device from a first wireless master communication device to a second wireless master communication device of the at least two wireless master communication devices, comprising the substeps of:

communicating between the first and second wireless communication device on a wide area network for transferring the at least one monitor device therebetween, providing a time-out period for the at least one monitor device to transfer from the local area network of the first communication device to the local area network of the second communication device acknowledging the receipt of the at least one monitor device into the second local area network by the second communication device to the first communication device over the wide area network, and wherein the triggering step includes triggering the alarm if the time-out period expires before the transferring step is complete.

2. The method of claim 1, wherein the transceiving step includes measuring the signal strength of one of the monitor devices at a predefined proximity boundary in the local area network by one of the at least two communication devices to define a threshold, and further comprising a step of assigning the threshold to all the monitor devices to define a group threshold, and wherein the triggering step includes triggering an alarm when the signal strength from any of the monitoring devices falls below the threshold.

3. The method of claim 1, wherein the transceiving step includes measuring the signal strength of each of the at least one wireless monitor devices at a proximity boundary predefined for each monitor device in the local area network to define individual thresholds therefor, and wherein the triggering step includes triggering the alarm when the when the signal strength from any of the monitoring devices falls below their respective individual threshold.

4. The method of claim 1, wherein the transferring step further comprises the substep of transmitting the time-out period to the second communication device, and wherein the triggering step includes triggering of the alarm in the second communication device if the timeout period expires before the second communication device receives the signal from the at least one monitoring device.

5. The method of claim 1, further comprising the step of slaving each of the at least one wireless monitor devices to an authorized master communication device with the strongest received signal when the local area networks are merged.

6. The method of claim 1, wherein the providing step includes the at least one wireless communication devices being operable on a wide area network, wherein after the comparing step further comprising the steps of:

if the signal strength from the slave unit to the master unit is no longer detected, querying at least one other of the at least one communication devices on the wide are network to determine if any of these communication devices can detect the particular slave unit in question on their associated local area network;

waiting a timeout period for all such at least one other communication devices to respond affirmatively; and transferring master authority over the slave unit to any of the at least one other communication devices that responds affirmatively during the waiting step.

7. A proximity monitoring communication system using at least two wireless local area networks, the system comprising:

at least two master wireless communication devices operable on a wide area network with each master wireless communication device supporting a respective wireless local area network; and at least one wireless monitor device operable as a slave unit in an associated wireless local area network, the at least one wireless monitor device transceiving signals on the local area network with a first of the at least two master wireless communication devices;

the at least two master wireless communication devices operable to detect a received signal from the at least one wireless monitor device, wherein loss of detection of the received signal in a particular local area network triggers an alarm on the wireless communication devices supporting the particular local area network, indicating that the at least one wireless monitor device is no longer within the proximity of the particular local area network, and wherein:

the first master communication device communicates to a second master communication device on the wide area network that the at least one monitor device will be transferred from the local area network of the first communication device to the local area network of the second communication device, and wherein the first communication device provides a timeout period for the at least one monitor device to transfer to the local area network of the second communication device, and the receipt of the at least one monitor device into the local area network of the second communication device is acknowledged by the second communication device to the first communication device over the wide area network, and the alarm is triggered if the time-out period expires before the transfer is complete.

8. The system of claim 7 wherein the wireless communication devices are operable to measure a strength of the received signal from the at least one wireless monitor device at a predefined proximity boundary in the local area network to define a threshold that is applied to all the monitor devices to define a group threshold, wherein a received signal strength of less than the threshold from any of the monitoring devices triggers the alarm.

9. The system of claim 7, wherein the signal strength of each of the at least one wireless monitor devices is measured at a proximity boundary predefined for each monitor device in the local area network to define individual thresholds therefor, wherein when the signal strength from any of the monitoring devices falls below their respective individual threshold the alarm will be triggered in at least one of the at least two wireless communication devices.

10. The system of claim 7, wherein the time-out period is communicated to the second communication device to trigger the alarm therein if the timeout period expires before the second communication device receives the signal from the at least one monitoring device.

11. The system of claim 7, wherein each of the at least one wireless monitor devices will slave to an authorized master communication device with the strongest received signal when the local area networks are merged.

12. The system of claim 7, wherein if the signal from the slave unit to the first master communication device is no longer detected, the first communication device queries the second master communication device on the wide are network to determine if the second master communication device can detect the particular slave unit in question on its associated local area network, wherein the first master communication device waits a timeout period for the second communication device to respond affirmatively and transfers master authority over the slave unit to the second communication device upon such affirmation.

* * * * *

UNITED STATES PATENT AND TRADEMARK OFFICE

CERTIFICATE OF CORRECTION

PATENT NO. : 6,563,427 B1
DATED : May 13, 2003
INVENTOR(S) : Bero et al.

It is certified that error appears in the above-identified patent and that said Letters Patent is hereby corrected as shown below:

Column 9,
Line 47, delete the second occurrence of "when the".

Signed and Sealed this

Sixteenth Day of September, 2003

JAMES E. ROGAN
*Director of the United States Patent and Trademark Office*